US005607336A

United States Patent [19]

Lebensfeld et al.

[11] Patent Number: 5,607,336

[45] Date of Patent: Mar. 4, 1997

[54] SUBJECT SPECIFIC, WORD/PHRASE SELECTABLE MESSAGE DELIVERING DOLL OR ACTION FIGURE

[75] Inventors: Steven Lebensfeld, 805 Pond La., Woodsburgh, N.Y. 11598; Harvey Goldberg, 8 Northbank Court, Thornhill, Ontario, Canada, L3T 7J7; David K. K. Chu, Block A & B 3/F., CDW Bldg., 382-392 Castle Peak Road; Ma H. Wai, both of Tsuen Wan, N.T., Hong Kong

[73] Assignees: Steven Lebensfeld, Woodsburgh, N.Y.; Harvey Goldberg, Thornhill, Canada; David K. K. Chu, Tsuen Wan, Hong Kong

[21] Appl. No.: 503,896

[22] Filed: Jul. 18, 1995

Related U.S. Application Data

[63] Continuation of Ser. No. 986,796, Dec. 8, 1992, abandoned.

[51] Int. Cl.[6] ..... A63H 3/28

[52] U.S. Cl. ..... 446/297; 446/299; 446/302; 446/98

[58] Field of Search ..... 446/98, 295, 296, 446/297, 298, 299, 300, 301, 302, 303, 404, 409; 434/236, 317, 322, 395, 396

[56] References Cited

U.S. PATENT DOCUMENTS

| | | | |
|---|---|---|---|
| 4,516,950 | 5/1985 | Berman et al. . | |
| 4,646,350 | 2/1987 | Batra . | |
| 4,696,653 | 9/1987 | McKeefery | 446/303 X |
| 4,710,145 | 12/1987 | Hall Vandis | 446/302 X |
| 4,802,879 | 2/1989 | Rissman et al. . | |
| 4,809,335 | 2/1989 | Rumsey . | |
| 4,820,233 | 4/1989 | Weiner . | |
| 4,878,871 | 11/1989 | Noto | 446/302 |
| 4,884,974 | 12/1989 | DeSmet | 434/317 |
| 4,911,670 | 3/1990 | McNicholas et al. | 446/487 X |
| 4,923,428 | 5/1990 | Curran | 446/299 X |
| 4,990,092 | 2/1991 | Cummings | 434/317 |
| 4,993,983 | 2/1991 | Kurita et al. . | |
| 5,004,442 | 4/1991 | Lemelson et al. | 446/302 |
| 5,073,140 | 12/1991 | Lebensfeld et al. . | |
| 5,092,810 | 3/1992 | Kwan et al. . | |
| 5,145,447 | 9/1992 | Goldfarb | 446/397 X |
| 5,167,508 | 12/1992 | McTaggart | 434/317 |
| 5,245,007 | 10/1993 | Eagan | 446/397 X |
| 5,376,038 | 12/1994 | Arad et al. | 446/297 |

FOREIGN PATENT DOCUMENTS

| | | | |
|---|---|---|---|
| 1248355 | 1/1989 | Canada . | |
| 231142 | 8/1987 | European Pat. Off. | 446/297 |
| 2572300 | 5/1986 | France | 446/409 |
| 9303293 U | 8/1993 | Germany . | |
| WO83/04184 | 12/1983 | WIPO . | |

OTHER PUBLICATIONS

"Julie: The Application of DSP to a Consumer Product", Speech Technology, Sep./Oct., 1988 No. 3, New York, NY, USA, pp. 82–86.

*Primary Examiner*—Robert A. Hafer
*Assistant Examiner*—D. Neal Muir
*Attorney, Agent, or Firm*—Rosen, Dainow & Jacobs Limited Liability Partnership

[57] ABSTRACT

A uniquely constructed message delivering doll or action figure is attained, which is capable of providing, when activated, words or phrases specifically relating to one desired, precise subject, activity, profession or area of interest for which the doll or action figure is dressed, by providing a toy doll or action figure which incorporates an audio generator contained therein for producing audible messages, message containing components removably interconnectable therewith, and outfits of wearing apparel for designating or relating to one specific subject, activity, profession, or area of interest. Each message containing component comprises a plurality of messages, each of which is specifically related to a particular subject, activity, profession, or area of interest designated by an outfit of wearing apparel.

1 Claim, 3 Drawing Sheets

FIG. 1
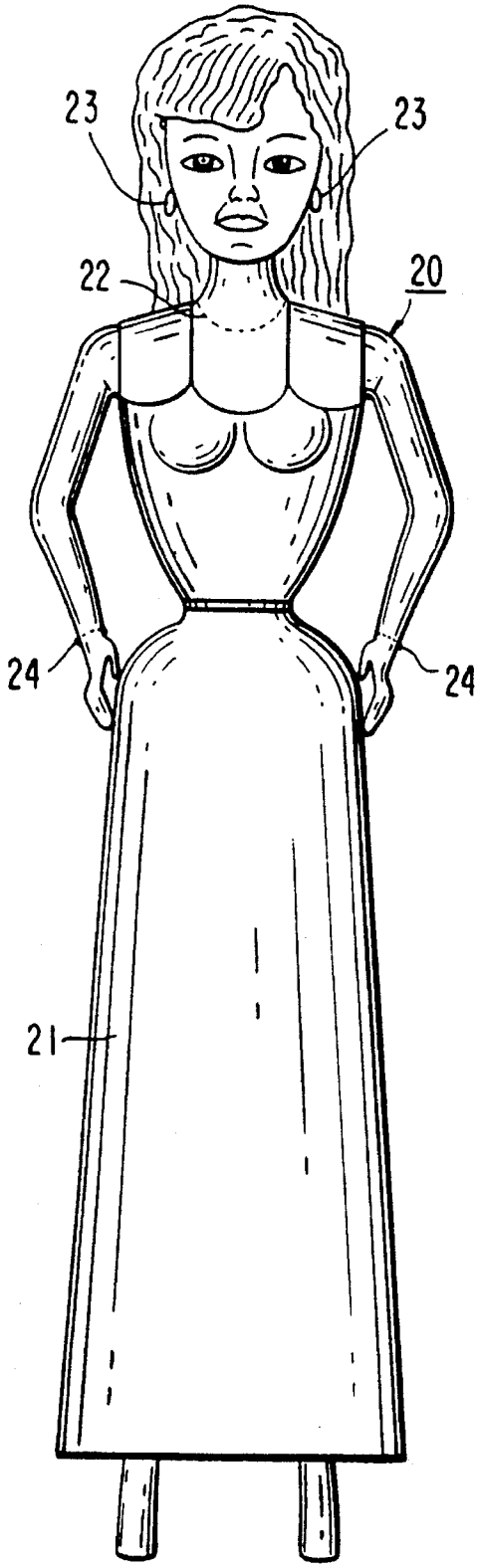
FIG. 2
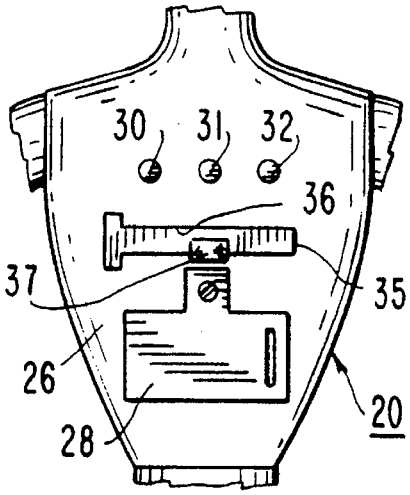
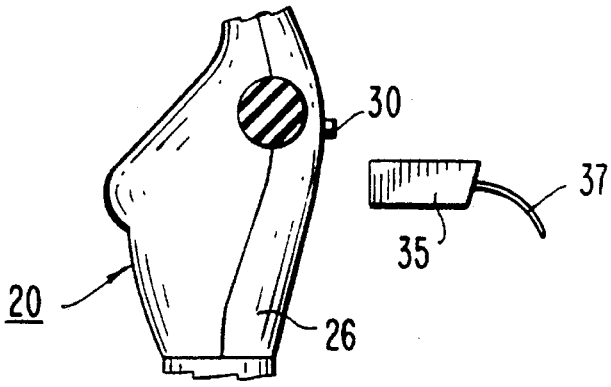
FIG. 3

SUBJECT SPECIFIC, WORD/PHRASE SELECTABLE MESSAGE DELIVERING DOLL OR ACTION FIGURE

This application is a continuation of application No. 07/986,796, filed Dec. 8, 1992, now abandoned.

TECHNICAL FIELD

This invention relates to toy action figures, principally toy dolls and, more particularly, to dolls constructed for audibly enunciating specifically desired and selected words or phrases.

BACKGROUND ART

Since their inception, toy dolls or action figures have been extremely popular with children in a broad range of ages. As this popularity has grown, prior art toy dolls and action figures have become more sophisticated, incorporating circuitry in the doll itself, or in attachments for the doll, which provides audible messages or sound effects. Although the prior art delivery of audible messages or sound effects has been reasonably successful in providing children with a greater degree of excitement or enthusiasm over non-verbal dolls, these prior art systems have been incapable of providing predictable, focused entertainment for the children in a manner which is controllable by the children using these prior art dolls or action figures.

The conventional prior art doll or action figure constructions are disclosed in the following patents: U.S. Pat. No. 5,092,810; U.S. Pat. No. 5,073,140; U.S. Pat. No. 4,820,233; U.S. Pat. No. 4,809,335; and U.S. Pat. No. 4,696,653. In addition, the references cited in these patents also disclose the state of this art.

In particular, the prior art dolls are constructed to enunciate words or phrases in either a preset sequence or in a random sequence with the words or phrases being selected from a finite prerecorded vocabulary or group of phrases. Although these prior art dolls or action toys do provide the children with some degree of entertainment, the child is unable to control the doll by focusing the doll's speech abilities in a particular area desired by the child. Instead, the words or phrases enunciated by the doll, when activated by the child, are continuously repeated or automatically selected randomly. However, the audible words are incapable of being controlled by the child.

Similarly, prior art dolls or action toys which connect to sound producing attachments, have audio producing means formed within the attachment which is specifically limited to sound effects or prerecorded words or phrases repeated in a manner similar to the talking doll. Consequently, these prior art devices are also incapable of providing the degree of control or focus sought by many children.

Therefore, it is a principal object of the present invention to provide a toy doll or action figure which is capable of providing audible messages specifically limited to a particular subject, activity, or area of interest desired by the user.

Another object of the present invention is to provide a talking doll or action figure having the characteristic features described above which is capable of being completely controlled by the user to enunciate one or more independent statements, words, or phrases relevant to one particular subject, activity or interest area.

Another object of the present invention is to provide a talking doll or action figure having the characteristic features described above which is easy to use, while also being quickly and easily adapted to a wide variety of alternate activities, subjects or interest areas, totally in the control of the user.

Other and more specific objects will in part be obvious and will in part appear hereinafter.

SUMMARY OF THE INVENTION

By employing the present invention, the drawbacks of the prior art talking dolls and action figures has been eliminated and a talking doll or action figure is attained which is capable of being employed by the user in a wide variety of different circumstances, all with the user having complete control over the audible messages being delivered. In this way, children employing the talking doll or action figure of the present invention are able to integrate the talking doll or action figure directly into a precise activity desired by the child whenever the child wishes.

For many years, one principal goal with toys, particularly action toys or dolls, has been to enable the child to use creativity and imagination in using the toy. In addition, by providing a child with the ability to control or focus the play in a desired area, greater confidence and self-esteem is believed to be obtained by the child.

Unfortunately, prior art talking dolls or action toys have been unable to allow children to have real control over the words, phrases, or sounds produced. In order to eliminate this prior art failing, the talking doll or action figure of the present invention is universally applicable in virtually any circumstance desired, with complete assurance that the oral messages controllably enunciated by the talking doll or action figure are directly related to the precise situation sought by the child.

In the preferred embodiment of the present invention, generally conventional circuitry is mounted within the talking doll or action figure for producing the desired audible messages. In accordance with this invention, specially created, activity or event-oriented, audible messages are contained on a read only memory (ROM) chip which is removably mountable in the talking doll or action figure. By providing a plurality of such ROM chips, any desired group of messages specifically related to one particular area of interest, subject, or activity is easily attained by merely inserting the desired ROM chip into the talking doll or action figure, whenever audible messages relating to that particular subject, activity, or area of interest is desired by the child.

In accordance with the present invention, the usability, excitement and interest of the child are further expanded, enhanced and heightened by providing each ROM chip with a specific outfit or uniform particularly related to the precisely desired activity, subject or interest area. In this way, the present invention enables children to attain complete control over their interaction with talking dolls or action figures, with the doll or action figure being completely controllably dedicated to one desired activity, selected by the child. By employing the present invention, the child can select from a plurality of independent, separate, unique activities, areas of interest or subjects such as sports (i.e., fishing, swimming, horseback riding, baseball, football, etc.), leisure activities (i.e., dining, dancing, shopping, etc.) and/or businesses or careers (i.e., doctors, lawyers, mailmen, students, construction workers, policemen, armed servicemen, etc.).

In the present invention, clothing, a uniform, or an outfit for the doll or action figure is specially designed for use in one particular area of interest, activity or subject. In addition to having clothing, a uniform, or an outfit specifically relating to one particular subject area or activity, a ROM chip is associated with the outfit for being inserted into the doll or action figure prior to dressing the doll or action figure in the appropriate clothing. In this way, the doll has the precise visual appearance for the particular desired activity, area of interest or subject, while also being capable of audibly delivering a plurality of Words or phrases specifically related to the particular subject area selected by the child at that particular time.

By employing the present invention, the child playing with the doll or action figure is capable of having the doll enunciate words and phrases which are specifically related to the desired activity, while also being dressed in a manner corresponding to the desired activity. By having a precise activity, selected by the child, specifically played by the doll, both visually and audibly, excitement is increased and play enhancement is achieved in the mind of the child.

In the preferred embodiment, a plurality of words and phrases are contained on each ROM chip, with each word or phrase being selectable by the user. Preferably, separate activation buttons are mounted on the doll for selectively activating any one of the separate words or phrases to be enunciated. Alternatively, if desired, a plurality of words or phrases may be enunciated by the doll in response to each activation.

In the preferred embodiment, each of the plurality of buttons mounted on the doll or action figure would always cause the same words or phrases to be enunciated. In this way, the child playing with the doll can selectively choose the precise phraseology for the doll to speak in response to a particular activity in the desired subject area. Although complete random phraseology and enunciation can be employed, without departing from the scope of the invention, it is preferred that selective enunciation of the words and phrases be employed to enhance and heighten the child's interest and excitement.

The invention accordingly comprises the features of construction, combinations of elements, and arrangement of parts which will be exemplified in the constructions hereinafter set forth, and the scope of the invention will be indicated in the claims.

THE DRAWINGS

For a fuller understanding of the nature and objects of the invention, reference should be had to the following detailed description taken in connection with the accompanying drawings, in which:

FIG. 1 is a front elevation view of a talking doll in accordance with the present invention and dressed in a long gown;

FIG. 2 is a rear elevation view, partially broken away, of the talking doll of FIG. 1 with the clothing removed to reveal the construction details thereof;

FIG. 3 is a side elevation view of the torso of the talking doll depicted in FIG. 2 and shown with the ROM chip removed therefrom;

DETAILED DESCRIPTION

Figure 4:
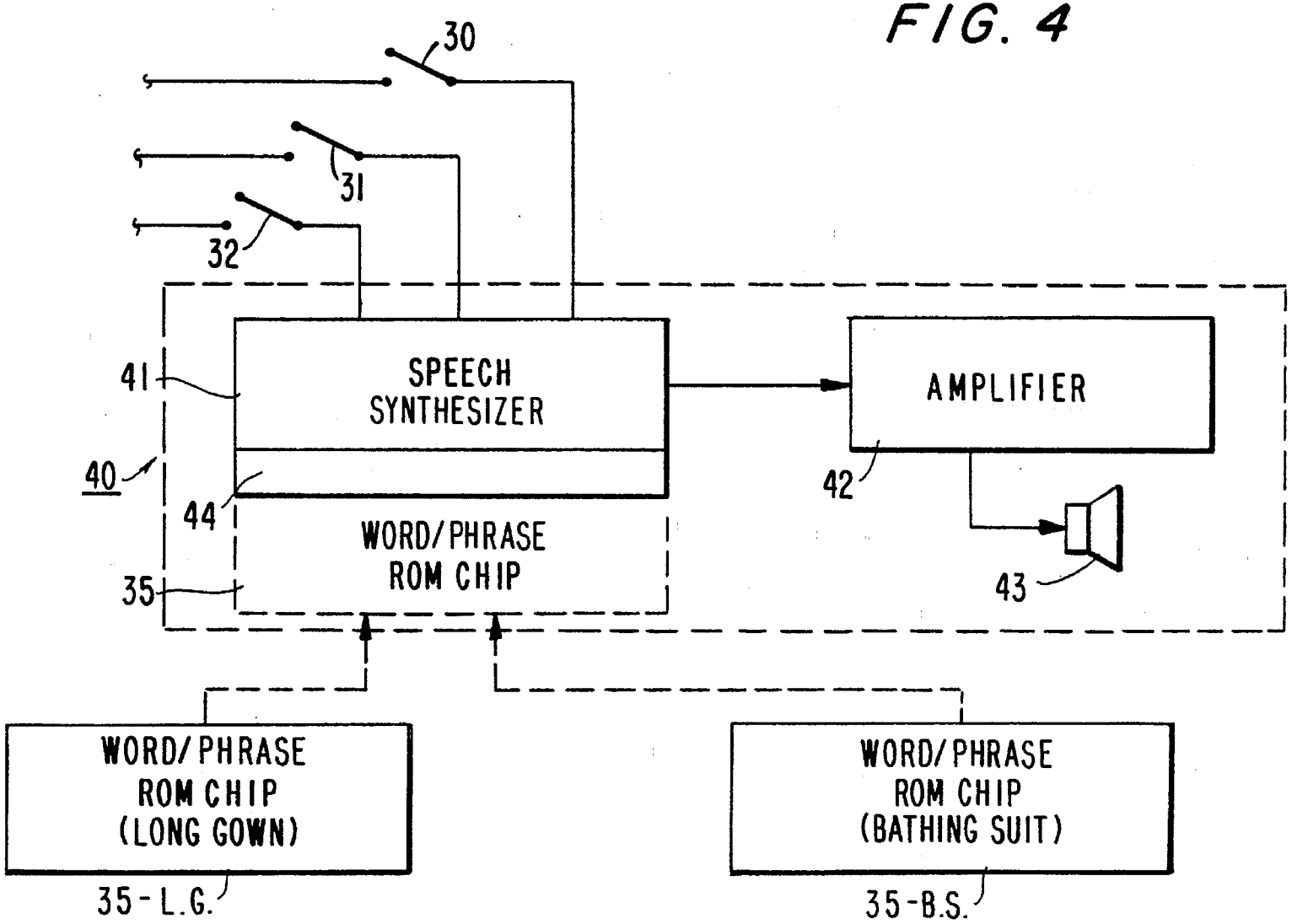
FIG. 4 is a functional block diagram of the audio generating apparatus mounted in the talking doll of the present invention.
Figure 5:
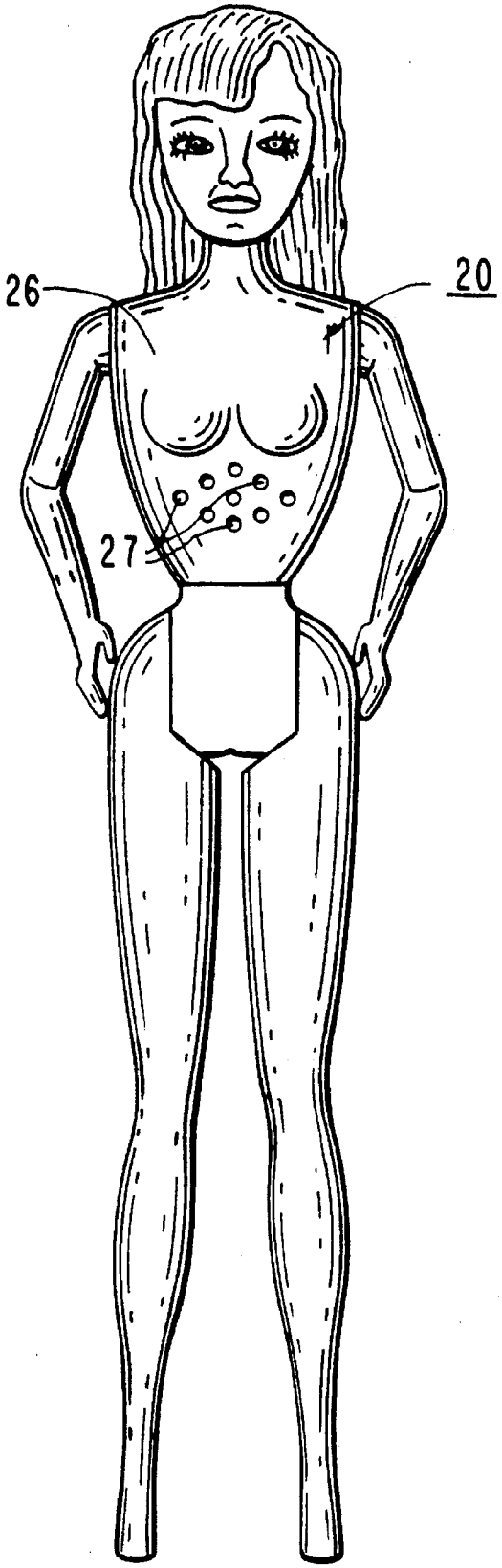
FIG. 5 is front elevation view of the talking doll of FIG. 1 with all clothing removed.

By referring to FIGS. 1–6, along with the following detailed disclosure, the construction and operation of the talking doll or action figure assembly of the present invention can best be understood. For purposes of disclosure only, the present invention is detailed herein in reference to subject specific, word/phrase selectable talking doll 20, depicted in the drawings. However, talking doll 20 which is configured to represent a female, is shown merely for exemplary purposes, without in any way intending to limit the present invention to female dolls. As will be apparent from the following detailed disclosure, male dolls and action figures of any kind may also incorporate the teaching of the present invention, without departing from the scope of this invention.

In FIG. 1, subject specific, word/phrase selectable talking doll 20 is depicted fully assembled and clothed in a long, formal gown 21. Gown 21 is constructed to represent the type of clothing a female would wear in the evening when attending a party, a ball, or dining in a restaurant.

As a result, whenever a child would like to play with doll 20 and desires to emulate the situation wherein doll 20 is attending an elegant cocktail party or dining out in a fancy restaurant, doll 20 would be dressed in gown 21 along with appropriate jewelry such as necklace 22, earrings 23 and bracelets 24, 24. In addition, as detailed below, a particular ROM chip specifically associated with gown 21 is securely mounted in doll 20 in order to assure that the audible messages selectively enunciated by doll 20 correspond to the activity the child precisely desires doll 20 to experience and enjoy.

In order to best understand the construction and operation of subject specific, word/phrase selectable, talking doll 20 of this invention, reference should be made to FIGS. 2–5, along with the following detailed disclosure. As depicted therein, the preferred embodiment of subject specific, word/phrase selectable, talking doll 20 comprises an audio generating circuit preferably mounted in torso 26 of doll 20. Preferably, the front forming portion of torso 26 of talking doll 20 incorporates a plurality of apertures 27 formed therein, behind which is mounted a speaker through which subject specific, selected words and phrases enunciated by talking doll 20 are transmitted for being easily heard by the child.

Torso 20 also incorporates a cover plate 28 preferably located on the back surface of torso 26 of doll 20, behind which the requisite electronic circuitry forming the audio generating system employed in talking doll 20 is securely maintained. Except for battery replacement, cover 28 is otherwise securely mounted to torso 26, since the circuitry need not be accessed by the user.

In the preferred embodiment, subject specific, word/phrase selectable, talking doll 20 of the present invention also incorporates a plurality of independent switch means 30, 31, and 32 which are also preferably mounted on the back or rear surface of torso 26. In the preferred embodiment, three switch means 30, 31, and 32 are employed. However, any desired number of switch means can be employed without departing from the scope of this invention.

Finally, the construction of subject specific, word/phrase selectable, talking doll 20 of the present invention is completed by providing ROM chip 35 which is constructed for being removably insertable into torso 26 of talking doll 20. As depicted in FIGS. 2 and 3, ROM chip 35 is preferably removably mounted in association with the back or rear surface of torso 26, constructed for sliding interengagement with receiving slot 37 formed in torso 26 of talking doll 20.

In order to assure ease of insertion and removability of ROM chip 35 in slot 36 of torso 26 of doll 20, ROM chip 35 is preferably constructed with a generally T-shaped configuration. In this way, assurance is provided that ROM chip 35 is inserted into torso 26 of talking doll 20 in the precisely desired orientation.

Furthermore, ROM chip 35 also incorporates a flexible holder or tab means 37 formed along one surface thereon, one end of which is securely embedded in ROM chip 35. By employing holder or tab 37, ROM chip 35 is easily moved from torso 26 of talking doll 20 for being changed to an alternate ROM chip when desired by the user.

In FIG. 4, the preferred embodiment for the audio producing circuitry incorporated in torso 26 of talking doll 20 is depicted in a functional block diagram. Although this overall circuit construction is preferred, a variety of alternate configurations can be employed to achieve substantially the same result, without departing from the scope of this invention. Consequently, all alternate variations are intended to be within the scope of the present invention.

As depicted in FIG. 4, audio producing circuit 40 comprises a speech synthesizer 41 which, in conjunction with ROM chip 35, contains the requisite circuitry for generating the audio signal for producing the desired words or phrases. The output of speech synthesizer 41 is transmitted to amplifier 42 which boosts the signal and transmits that signal to amplifier 43. As detailed above, amplifier 43 is preferably positioned behind apertures 27, in order to assure that the words and phrases generated by audio producing circuit 40 are easily heard and understood by the user.

In order to produce words or phrases which are specifically related to the precisely desired subject, activity, or area of interest, speech synthesizer 41 incorporates chip interconnecting means 44 which is constructed for removably, electronically interconnecting with any desired word/phrase containing ROM chip 35. By providing a plurality of ROM chips 35, each of which is specially constructed for use with one particular outfit, uniform, or clothing, and is easily interconnected with speech synthesizer 41 through interconnecting means 44, subject specific, word/phrase selectable talking doll 20 of this invention is realized.

As depicted in FIG. 4, when ROM chip 35-L.G. is electronically interconnected with speech synthesizer 41, audio producing circuit 40 is ready to produce the particular words and phrases contained on ROM chip 35-L.G. which is specifically limited to words and phrases which would be said by a female doll while dining in a fine restaurant or attending a formal dance or ball. As a result, the words or phrases produced by ROM chip 35-L.G. are specifically limited to words and phrases which would be specifically stated by a female when dressed in long gown 21.

By employing the present invention, a child wishing to emulate the activities and verbal exchanges which would be expected during fine dining or dancing, can be easily attained by inserting ROM chip 35-L.G. in torso 26 of doll 20 and then dressing doll 20 with long gown 21 and the associated jewelry accessories. Then, by activating switch means 30, 31 or 32, at any desired time, doll 20 will specifically enunciate words or phrases which correspond to the precise activities for which doll 20 has been dressed and which the child playing with talking doll 20 has selected for being emulated.

As discussed above, the preferred embodiment of the present invention employs three separate and independent switches 30, 31 and 32 in order to activate three separate and independent segments or groups of words or phrases contained on a particular ROM chip 35 when inserted in torso 26 of doll 20. As depicted in FIG. 4, when ROM chip 35 is interconnected with speech synthesizer 41, the activation of switch means 30 will cause one of the word/phrase groups or selections contained on ROM chip 35 to be transmitted to amplifier 42 and speaker 43. Similarly, by pressing switch means 31 or 32, the other groups or segments of words or phrases contained on ROM chip 35 are separately activated for enunciation and delivery by talking doll 20 at the desired time.

As discussed above, the teaching of the present invention can be employed in a plurality of alternate constructions or arrangements. In particular, instead of enunciating a single word or phrase upon activation of one of the switch means, a plurality of words or phrases can be transmitted each time one of the switch means is activated.

Similarly, any desired number of switch means can be employed for separately activating a corresponding number of words or phrases. The only requirement is that ROM chip 35 must contain the same number of separate words or phrase groups or segments as doll 20 contains switch means.

In the present invention, ROM chip 35-L.G. contains a plurality of words or phrases specifically focused on the desired activity doll 20 will be experiencing when wearing gown 21. Since gown 21 would be worn when visiting an exclusive restaurant, ROM chip 35 contains a group of words or phrases such, as "the food here is wonderful"; "this waiter is superb"; "do you think we should order an appetizer"; and "everything on that dessert tray looks exquisite". In addition, since gown 21 would also be worn by doll 20 when attending a high fashion dance or ball, ROM 35-L.G. also contains specific activity oriented phrases such as "this music is the best I have ever heard"; "I'm tired, but I don't want to stop dancing"; "the gowns being worn here tonight are elegant"; and "I wish we could dance all night".

As is apparent from the foregoing disclosure, ROM chip 35-L.G. is constructed to provide words or phrases, when activated, which are specifically related to the activity doll 20 would be experiencing when wearing long gown 21. Consequently, the present invention provides, for the first time, a talking doll which is effectively programmed by the child to deliver words or phrases specifically related to the clothing or uniform the child has placed on doll 20. As a result, the child playing with talking doll 20 of the present invention is capable of achieving complete control over the precise activity and statements made by subject specific, word/phrase selectable, talking doll 20, so as to assure that doll 20 delivers the phraseology, words or statements which are specifically related to the precise activity the child desires doll 20 to experience.

Figure 6:
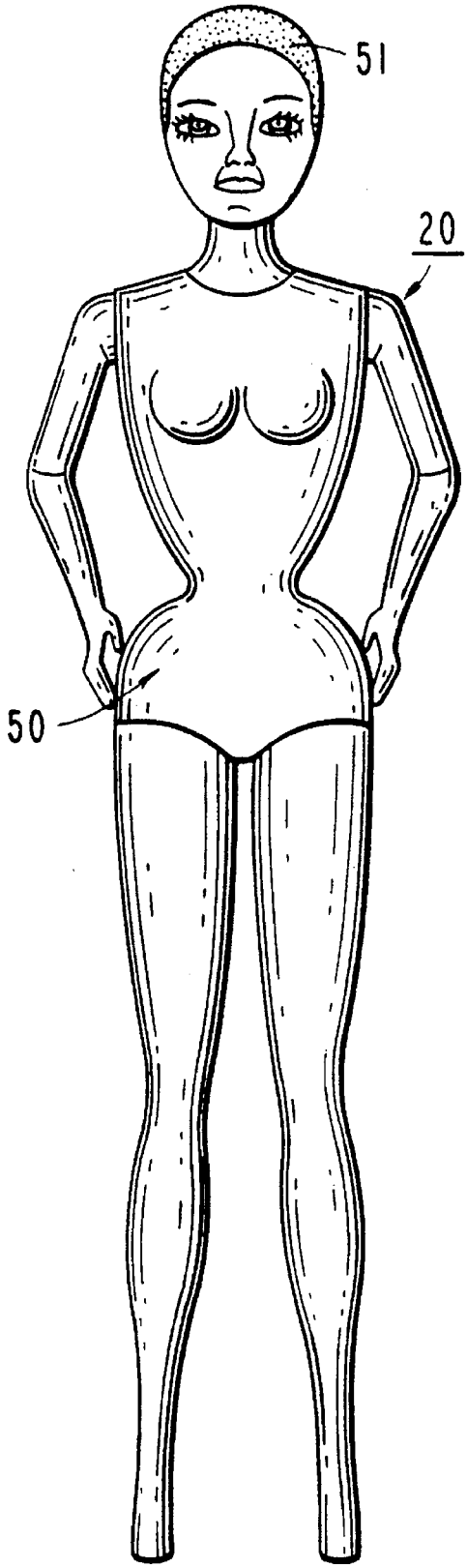
FIG. 6 is a front elevation view of the talking doll of FIG. 1, dressed in a swimming suit.

In order to show the wide variety of activities, subjects, and areas of interest which a child can enjoy while playing with doll 20, doll 20 is depicted in FIG. 6, ready to enjoy another totally different specific area. As shown in FIG. 6, doll 20 is dressed in a bathing suit 50, ready for enjoying activities at a beach or in a swimming pool. If desired, doll 20 can also wear a bathing cap 51, as shown in FIG. 6.

Prior to dressing doll 20 with bathing suit 50, ROM chip 35, mounted in upper torso 26 of doll 20, would be removed, by pulling on tab 37, with removed ROM chip 35 being retained in association with the costume or clothing to which that particular ROM chip is related. Then, ROM chip 35-B.S., as depicted in FIG. 4, is inserted in slot 36 of torso 26 of talking doll 20, with the connecting pins of ROM chip 35-B.S. electronically engaging with interconnect means 44 of speech synthesizer 41. In this way, the words/phrases contained on ROM chip 35-B.S. are ready for being activated for transmission through amplifier 42 to speaker 43, in response to the selective pressing of switch means 30, 31, or 32.

In order to enable a child playing with subject specific, word/phrase selectable talking doll 20 on a beach or in a water-oriented environment, which coordinates with the wearing of a swim suit by doll 20, ROM chip 35-B.S. is constructed with a plurality of words/phrases related only to swimming and beach activities. For example, ROM chip 35-B.S. is constructed with phrases such as "The sun feels great"; "I hope we get a good tan"; "Let's go swimming"; "The water is perfect"; "Let's play ball in the water"; and "Do you want to build a sand castle".

As is apparent from this disclosure, whenever a child desires to play with doll 20 in a manner which would emulate the activities one would experience at a beach or swimming pool, the child would insert ROM chip 35-B.S. into doll 20, and dress doll 20 in bathing suit 50. Then, each time switch means 30, 31, or 32 is activated, the words or phrases enunciated by doll 20 will be specifically related to the precise beach/pool activities the child sought to experience.

As a result, a child is now able to fully and completely enjoy the roll-playing experience provided by dolls, while also being able to completely control the situation being experienced and the phraseology enunciated by doll 20. Whenever doll 20 is activated by the child, the words/phrases stated are specifically directed to the precise activity desired by the child. In this way, complete control is obtained by the child and greater self-esteem and self-importance is realized by enabling the child to independently select and integrate both the activity and speech of the doll.

As is apparent from the foregoing detailed disclosure, the present invention attains a subject specific, word/phrase selectable, talking doll which provides speech producing ROM chips specifically limited to a particular subject, activity, or area of interest, with each ROM chip being directly associated with a particular costume, outfit, or clothing. In this way, the child is able to insert the desired ROM chip 35 in doll 20 of the present invention and dress doll 20 with the uniform, outfit, or clothing associated with ROM chip 35 and the desired activity.

By employing the present invention, a unique achievement is realized. For the first time, a talking doll is provided which is able to be dressed to visually appear precisely as a child would expect for having the doll participate in a particular activity desired by the child, while also being selectively programmed to enunciate words/phrases specifically limited to and specifically related to the precise subject, activity, or area of interest for which doll 20 has been dressed. In this way, roll-playing situations are attained which are completely controlled by the child in a manner that has heretofore been unobtainable in any prior art doll construction.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. A visually and verbally coordinated toy doll or action figure capable of producing user-controlled, subject specific, audible messages, comprising a body forming the doll or action figure;

audio generating means contained within the body for producing audible messages when activated;

switch means controllably connected to the audio generating means for activation thereof;

a plurality of outfits of wearing apparel each constructed for being worn on the body of the doll or action figure, and configured for suggesting at least one of a specific activity and profession; and a plurality of message containing components, each comprising a plurality of messages each of which is both specific to and consistent with the specific activity or profession suggested by a selected one of said outfits of wearing apparel, and indicia carried by each of said message containing components which associates a message containing component with an outfit of wearing apparel; and means for removably interconnecting each of said message containing components and said audio generating means so that said audio generating means can produce said audible messages from messages contained in an interconnected message containing component.

* * * * *